United States Patent [19]

Deguchi et al.

[11] Patent Number: 4,696,724

[45] Date of Patent: Sep. 29, 1987

[54] SURFACE TREATMENT OF HIGH-NICKEL/IRON ALLOY STEEL PLATE FOR LNG OR LPG TANKS

[75] Inventors: Takenori Deguchi; Kazuko Uchida; Takao Ikita, all of Chiba; Shigeaki Maruhaski, Yamaguchi; Kazuo Hoshino, Yamaguchi; Keiji Oosaki, Yamaguchi, all of Japan

[73] Assignee: Nisshin Steel Co., Ltd., Tokyo, Japan

[21] Appl. No.: 844,979

[22] Filed: Mar. 27, 1986

Related U.S. Application Data

[60] Division of Ser. No. 652,611, Sep. 20, 1984, Pat. No. 4,592,965, which is a continuation-in-part of Ser. No. 392,131, Jun. 25, 1982, abandoned.

[30] Foreign Application Priority Data

Jun. 26, 1981 [JP] Japan ..... 56-98216

[51] Int. Cl.[4] ..... C23C 22/24; C23C 28/00

[52] U.S. Cl. ..... 204/27; 148/62; 204/38.1; 427/405; 427/438

[58] Field of Search ..... 204/27, 28, 35.1, 38.1, 204/40, 41; 427/305, 405, 438; 148/6.2

[56] References Cited

U.S. PATENT DOCUMENTS

| | | | |
|---|---|---|---|
| 2,975,073 | 3/1961 | DeLong et al. | 117/71 |
| 3,053,691 | 9/1962 | Hartman et al. | 148/6.2 |
| 3,053,692 | 9/1962 | Pocock | 148/6.2 |
| 3,088,846 | 5/1963 | Lee | 148/6.2 |
| 3,123,505 | 3/1964 | Pocock | 148/6.2 |
| 3,245,885 | 4/1966 | Asano et al. | 204/35 |
| 3,247,028 | 4/1966 | Klein et al. | 148/6.2 |
| 3,468,724 | 9/1969 | Reinhold | 148/6.2 |
| 3,994,694 | 11/1976 | Clauss et al. | 428/621 |
| 4,035,248 | 7/1977 | Asano et al. | 204/38 B |

FOREIGN PATENT DOCUMENTS

| | | |
|---|---|---|
| 2139950 | 1/1973 | France . |
| 534852 | 3/1941 | United Kingdom . |
| 547408 | 8/1942 | United Kingdom . |
| 762602 | 11/1956 | United Kingdom . |
| 938097 | 9/1963 | United Kingdom . |
| 1322008 | 7/1973 | United Kingdom . |
| 1361101 | 7/1974 | United Kingdom . |
| 1559355 | 1/1980 | United Kingdom . |
| 2079319 | 1/1982 | United Kingdom . |

*Primary Examiner*—John F. Niebling
*Assistant Examiner*—William T. Leader
*Attorney, Agent, or Firm*—Fleit, Jacobson, Cohn & Price

[57] ABSTRACT

High nickel/iron alloy steel plate for LNG or LPG tanks having 35–37% nickel content is plated with nickel in an amount of 1 to 10 g/m$^2$, and then chromated, except electro-chromating treatment, to obtain thereon a chromate film having a chromium content of 5 to 100 mg/m$^2$.

4 Claims, No Drawings

SURFACE TREATMENT OF HIGH-NICKEL/IRON ALLOY STEEL PLATE FOR LNG OR LPG TANKS

This is a divisional of application Ser. No. 652,611 filed Sept. 20, 1984, now U.S. Pat. No. 4,592,965 which is a continuation-in-part of application Ser. No. 392,131 filed June 25, 1982, now abandoned.

BACKGROUND OF THE INVENTION

The present invention relates to the surface treatment of high-nickel/iron alooy steel plate for LNG or LPG tanks having a 35–37% nickel content as provided by ASTM SA-658 to improve its corrosion resistance, in which the alloy steel plate is subjected to nickel plating and chromating (except electro-chromating).

Stainless steel or aluminum steel plates have mainly been used as the structural material for LNG or LPG tanks. Theses plates excel in corrosion resistance, and offer no particular problem in connection with rusting. However, the tanks referred to above are inevitably subject to a thermal cycle in which a temperature rise and a temperature drop occur repeatedly. In other words, the tank material does not stand up to use over extended periods, owing to its fatigue caused by repeated expansion and contraction. This is the reason why another material is now demanded. It is true the most suitable material for LNG or LPG tanks is high-nickel/iron alloy steel plate provided by ASTM SA-658 that has an extremely low coefficient of thermal expansion (about $1.0\times10^{-6}-2.0\times10^{-6}$/°C.) in view of fatigue but, as well-known in the art, this material is deficient in corrosion resistance, viz., shows a degree of corrosion resistance no more than that of normal-purpose steel plate, thus leaving behind a rusting problem before or after making tanks.

To prevent the high-nickel/iron alloy plate for LNG or LPG tanks from rusting, there may be two possibilities; one is the application of rust preventing oil, and the other is the application of a rust preventing film.

The application of rust preventing oil poses a slip problem and is dangerous at work, viz., unsatisfactory in view of workability, whereas the application of a rust preventing film is very costly since, upon coating, the film has to be removed by timeconsuming and laborious working, especially for welding purposes. If welding is effected with the alloy plate still coated with the rust preventing oil or film, blow holes or cracks then occur in the welded portion, resulting in a drop of the strength of the welded joint.

SUMMARY OF THE INVENTION

High-nickel/iron alloy steel plate for LNG or LPG tanks is well-known as provided by ASTM SA-658 (SPECIFICATION FOR PRESSURE VESSEL PLATES ALLOY STEEL 36% NICKEL). Nonetheless, it shows an insufficient degree of corrosion resistance under wet conditions.

It has now been found that such alloy steel plate shows improved corrosion resistance with its own properties being kept intact, if it is plated with nickel in an amount of 1 to 10 g/m$^2$ calculated as metal nickel.

As a result of extensive studies, it has also been found that, in comparison with various plating metals such as zinc, copper, cobalt or chromium, nickel is the most excellent in view of corrosion resistance as well as the adherence to the high-nickel/iron alloy steel plate for LNG or LPG tanks having 35–37% nickel content provided by ASTM SA-658.

However, no satisfactory corrosion resistance is obtained in the presence of halogen ions by nickel plating alone, since the nickel per se is of relatively high activity. In particular, microscopic peeling of the nickel layer may take place due to scratching or wearing during handling or working, resulting in a lowering of corrosion resistance. To this end, the outermost layer of nickel is passivated by intimate nickel oxide, and coated with a self-healing chromate film. Even it the nickel layer is damaged due to scratching, etc., it is again passivated by a chromic chromate or chromium phosphate film formed owing to the self-healing inherent in the chromate film coated on the nickel layer. This enables the high-nickel/iron alloy steel plate for LNG or LPG tanks to possess high corrosion resistance.

A main object of the present invention is therefore to provide the surface treatment process of high-nickel/iron alloy steel plate for LNG or LPG tanks, whereby the disadvantages or demerits of the prior art are eliminated.

Another object of the present invention is to provide the surface treatment process which can be carried out with easiness but at lower costs, using an existing installation, and give satisfactory rust-preventive properties to workpieces of high-nickel/iron alloy steel plate for LNG or LPG tanks without having an adverse influence on the properties characteristic thereof.

According to the present invention, high nickel/iron alloy steel plate for LNG or LPG tanks is first plated with nickel in an amount of 1 to 10 g/m$^2$ calculated as metal nickel, and then chromated to form a chromate film which is not an electro-chromate and which has a chromium content of 5 to 100 mg/m$^2$ calculated as metal chromium, thereby forming on the surface of the alloy steel plate a double or composite layer comprising the nickel layer and the chromate film.

These and other objects and features of the present invention will become apparent from a reading of the following detailed description.

DETAILED DESCRIPTION OF THE INVENTION

In the present invention, usual nickel plating methods may be applied electrolytically or non-electrolytically, and best results are obtained if nickel is used in an amount of 1 to 10 g/m$^2$ (about 0.11 to 1.12 microns thickness) calculated as metal nickel.

In a quantity of less than 1 g/m$^2$, no uniform and continuous layer of nickel is obtained with the nickel being spottily deposited as a result. To put it in another way, the resulting layer is deficient in corrosion resistance, and produces little or no synergistic effect on corrosion resistance, together with a chromate film formed in the next step. A sufficiently stabilized nickel layer is obtained in an amount of nickel up to 10 g/m$^2$. An amount of nickel exceeding 10 g/m$^2$, however, makes no appreciable contribution to improvements in corrosion resistance and weldability, and would cause fatigue because the coefficient of thermal expansion of nickel is about $13.3\times10^{-6}$/°C. (about 6.7–13.3 times that of the alloy plate) and instead, give rise to problems in connection with productivity and other economical considerations.

The chromating step following the nickel plating step may resort to ordinary techniques finding wide use in plates of zinc or aluminum or in steel plates treated with zinc or aluminum. In other words, satisfactory results are obtained if an aqueous solution containing hexavalent chromium and fluorides is used. Typical of that solution are those disclosed in Japanese examined publication Nos. 51-40536, 52-14691 and 55-9949 specifications as well as Japanese unexamined patent publication No. 49-74640. Further use may be made of commercially available liquid products, such as "ALOGINE #1000", "ZINCGUARD #1000" and "ALOGINE 407-47" (trademarks), manufactured by NIPPON PAINT Inc.

It is understood that the chromating solution used in the present invention includes a coating type chromating solution.

The term "coating type chromating solution" refers to the so-called "single-treatment coating type chromating agent" which is superseding phosphating or chromating (of the reaction type) heretofore applied to aluminium plates, cold rolled steel plates and galvanized iron, and now enjoying worldwide use as the pollution-conscious, non-rinse type chromating agent.

Basically, the aforesaid agent contains hexavalent chromium, $CrO_6$, in an amount of 10 to 200 g/l and trivalent chromium in an amount of 20 to 60% by weight relative to the total quantity of chromium, and may include silica or organics. Examples of this agent are commercially available products "ACOMET C" (trademark) manufactured by KANSAI PAINT Inc., "ALOGINE NR-2, NR-3" (trademarks) manufactured by NIPPON PAINT Inc., and a treating composition as disclosed in Japaneses unexamined patent publication No. 52-68036.

Any composition which is applied on the plate of 60° to 120° C. and, thereafter, dried to solid to provide a chromate type or chromate-phosphate type film may be used in the present invention. Since a chromium or chromic chromate film obtained by electro-chromating is costly and leads to a lowering of electric conductivity during welding, it is not effective.

It is of vital importance in the chromating according to the present invention that the resulting chromate film has a chromium content of 5 to 100 mg/m$^2$.

The chromate film is of insufficient corrosion resistance when it has a chromium content of less than 5 mg/m$^2$. When the chromium content exceeds 100 mg/m$^2$, on the other hand, no problem arises in connection with corrosion resistance; however, the resulting film shows poor adhesion to the high-nickel/iron alloy steel plate for LNG or LPG tanks and is, at the same time, subject to powdering with the result that microscopic peeling of the film takes place locally during working, e.g., bending. The occurrence of powdering also leads to a lowering of electric conductivity during welding.

Nickel is uniformly deposited on steel having a high nickel content, and shows good adhesion to the high-nickel/iron alloy steel plate for LNG or LPG tanks. The chromate film per se obtained by the chromate treatment is made virtually insoluble in water due to the presence of nickel.

Heretofore, the high-nickel/iron alloy steel plate has been available only for precision machines that need not possess corrosion resistance. According to the present invention, however, that alloy steel plate can be applied only to LNG or LPG tanks, to which corrosion resistance is inevitable, since it can be endowed with high corrosion resistance without harming the properties inherent in it whatsoever.

The surface treatment according to the present invention comprises a combination of nickel plating and chromate treatment, except electro-chromating treatment, that have been carried out on an industrial scale, produces a synergistic anticorrosive effect, and can be inexpensively undertaken on an industrial scale.

The present invention will now be elucidated with reference to the following non-restrictive examples.

EXAMPLES

A piece of 36% nickel/iron alloy steel plate, 0.8 mm in thickness, 220 mm in width and 300 mm in length, was electrolytically degreased in a treatment solution 50 g/l of sodium orthosilicate at 85° C. for 10 seconds with a current of 5 A/dm$^2$, washed with water to remove alkali residues, and immersed in a 5% hydrochloric acid solution of 20° C. for 20 seconds followed by washing with water. The thus treated piece was nickelled under the conditions specified in Table 1, washed with water and dried. The thus nickelled piece was subsequently chromate-treated under the conditions again specified in Table 1, washed with water and dried. In these procedures, a number of test pieces were prepared.

For the purpose of comparison, a number of control test pieces were prepared. Control run 1' was carried out without any surface treatment, and Control run 2' to 6' inclusive were done with the conventional treatment (see Table 1).

TABLE 1

| | | Surface treatment | | | | |
|---|---|---|---|---|---|---|
| | | Nickel Plating | | | | |
| | | | Conditions | | | Amount of |
| | Ex. No. | Method of Plating | Temperature (°C.) | Time (Sec) | Current Density (A/dm$^2$) | Ni Deposited (g/m$^2$) |
| Invention | 1 | Note (1) Acidic Ni plating | 30 | 30 | 5 | 5 |
| | 2 | Note (1) Acidic Ni plating | 40 | 30 | 1 | 1 |
| | 3 | Note (1) Acidic Ni plating | 40 | 100 | 3 | 10 |
| | 4 | Note (1) Acidic Ni plating | 30 | 30 | 5 | 5 |
| | 5 | Note (1) Acidic Ni plating | 40 | 30 | 1 | 1 |
| | 6 | Note (1) | 40 | 100 | 3 | 10 |

TABLE 1-continued

| | | | | | | |
|---|---|---|---|---|---|---|
| | | Acidic Ni plating | | | | |
| | 7 | Note (2) Electro-less Ni plating | 80 | 20 | — | 5 |
| Control | 1' | High-nickel/iron alloy Steel without Surface Treatment | | | | |
| | 2' | Note (1) Acidic Ni plating | 3 | 30 | 5 | 5 |
| | 3' | Note (1) Acidic Ni plating | " | " | " | " |
| | 4' | Note (1) Acidic Ni plating | " | " | " | " |
| | 5' | Note (1) Acidic Ni plating | 30 | 3 | 5 | 0.5 |
| | 6' | Note 8 Chrome-plating | 35 | 50 | 4 | Amount of Metal Chromium Deposited 0.3 (g/m$^2$) |

| | | Surface treatment | | | | | |
|---|---|---|---|---|---|---|---|
| | | Chromating | | | | | |
| | | | | Conditions | | | Amount of |
| | Ex. No. | Type of Treatment | Name or Composition of Treatment Solution | Liquid Temp. (°C.) | Time (Sec) | Type of Treatment | Chromium in Film (mg/m$^2$) |
| Invention | 1 | Reaction Type Chromating | Note (3) Alogine #1000 5 g/l content calculated as Chromic acid | 70 | 3 | Spraying | 5 |
| | 2 | Reaction Type Chromating | $CrO_3$ 25 g/l, $H_3PO_4$ 0.5 g/l, $NH_4SiF_6$ 0.8 g/l Note (5) | 70 | 10 | " | 20 |
| | 3 | Coating Type Chromating | Note (4) Acomet C | 20 | — | Roll Coating | 100 |
| | 4 | Coating Type Chromating | Note (3) Alogine NR-2 | 20 | — | Roll Coating | 50 |
| | 5 | Coating Type Chromating | Note (6) $CrO_3$ 50 g/l, $H_3PO_4$ 40 g/l Malonic acid 20 g/l, $Cr^{+3}$ 25 g/l | 40 | — | Roll Coating | 80 |
| | 6 | Reaction Type Chromating | Note (3) Alogine 407-47 (407 . . . 4% 47. . . 0.4%) | 60 | 10 | Spraying | 20 |
| | 7 | Reaction Type Chromating | $CrO_3$ 30 g/l, $CoSO_4.7H_2O$ 10 g/l, $Na_2SiF_6$ 5 g/l Note (7) | 70 | 7 | " | 30 |
| Control | 1' | High-nickel/iron alloy Steel without Surface Treatment | | | | | |
| | 2' | Non-chromated (Green product) | | | | | |
| | 3' | Reaction Type Chromating | $CrO_3$ 2 g/l, $H_3PO_4$ 1 g/l, $NH_4SiF_{,6}$ 0.5 g/l Note (5) | 60 | 5 | Spraying | 3 |
| | 4' | Coating Type Chromating | Note (3) Alogine NR-2 | 20 | — | Roll Coating | 150 |
| | 5' | Coating Type Chromating | Note (3) | 20 | — | Roll Coating | 20 |
| | 6' | Reaction Type Chromating | $CrO_3$ 35 g/l | 35 | 10 | Electro-chromating 4A/dm$^2$ | 35 |

Note (1) - The acidic nickel plating bath used had the following composition:
Niekel sulfate 250 g/l
Nickel chloride 45 g/l
Boric acid 30 g/l
Note (2) - The electroless nickel plating bath used had the following composition:
Nickel chloride 12 g/l
Sodium hypophosphite 24 g/l
Sodium acetate 16 g/l
pH 4.5
Note (3) - ALOGINE #1000, ALOGINE NR-2 and ALOGINE 407-47 (trademarks) are all manufactured by NIPPON PAINT Inc.
Note (4) - ACOMET C (trademark) is manufactured by KANSAI PAINT Inc.
Note (5) - The composition used is disclosed in Japanese examined patent publication No. 55-9949.
Note (6) - The composition used is disclosed in Japanese examined patent publication No 52-68036.
Note (7) - The composition used is disclosed in Japanese unexamined patent publication No. 49-74640.
Note (8) - All the control runs resorted to conventional electro-chromating with the following plating bath: Chromic acid 130 g/l and sulfuric acid 1.3 g/l.
Experiments were effected in the order of chrome-plating, rinsing, electro-chromating and rinsing.

The test pieces were subjected to brine spray testing for the evaluation of corrosion resistance. The results are shown in TABLE 2.

TABLE 2

| | | Brine Spraying Test | | |
|---|---|---|---|---|
| Class | Ex. No. | Flat Note 2 | Bend Note 3 | Remarks |
| Invention | 1 | ○ | ○ | |
| | 2 | ○ | ○ | |
| | 3 | ◉ | ◉ | |
| | 4 | ◉ | ○ | |

TABLE 2-continued

| Class | Ex. No. | Brine Spraying Test Flat Note 2 | Bend Note 3 | Remarks |
|---|---|---|---|---|
| | 5 | ○ | ◎ | |
| | 6 | ○ | ○ | |
| | 7 | ◎ | ○ | |
| Control | 1' | xx | xx | (90% Red rust in 24 hours) |
| | 2' | x | xx | |
| | 3' | Δ | Δ | |
| | 4' | ◎ | Δ~ | |
| | 5' | x | xx | (30% red rust in 24 hours) |
| | 6' | ◎ | ◎ | |

Note 1 - The brine spray testing was carried out according to JIS Z 2371, and continued for 200 hours. The test results are evaluated in terms of the percentage of the corroded (red rust) area to the total area of the test piece.

| Mark | Evaluation (%) |
|---|---|
| X X | 91~100 Red Rust |
| x | 61~90 Red Rust |
| Δ | 31~60 Red Rust |
| ○ | 11~30 Red Rust |
| ◎ | 0~10 Red Rust |

Note 2 - The flat portion of the bend-free test piece was measured.

Note 3 - The bend of the test piece was subjected to bend testing and, then, brine spray testing to determine the occurrence of red rust. The test piece was bent at 180° along two inner plates.

As will be appreciated from Table 2, the products according to the present invention excel in corrosion resistance. In the case of the green piece of high-nickel-/iron alloy steel plate, 90% of its total area was already corroded after 24 hours. When the amount of nickel deposited was insufficient, as is the case with control run 5' in which 0.5 g/m$^2$ of nickel and 20 mg/m$^2$ of chromium were deposited onto the test piece, the test piece was also rapidly corroded, and the red rust accounted for 30% of the total area of the test piece after 24 hours.

When the amount of chromium was considerably reduced, as is these with control run 3' in which 5 g/m$^2$ of nickel and 3 mg/m$^2$ of chromium were deposited onto the test piece, the test piece showed insufficient corrosion resistance. When the amount of chromium was considerably above the upper limit defined in the claim, there was no problem in connection with the corrosion resistance of the test piece without any bend; however, there was a variation in the corrosion resistance of the test piece having a bend (control run 4').

The product of examples 1 to 7 of the present invention show constant and good corrosion resistance. Although the product of control run 6' excels in corrosion resistance, it poses a problem in connection with weldability, as described later.

In most cases, thin plates are generally welded by resistance welding or tungsten inert gas welding (TIG welding). For this reason, the weldability of the product of example 1 (nickel plating plus chromating) was estimated with the use of resistance seam welding and TIG welding. For the purpose of comparison, the weldability of the product of control run 1'-36% nickel/iron alloy steel plate (hereinafter referred to as the green product) - and of the product electro-chromated according to control run 6' was similarly estimated.

TABLE 3

| Seam Welding Condition | |
|---|---|
| Thickness of Test Piece | 0.7 mm$^t$ × 3 |
| Predetermined Current Value | 8,000A |
| Welding Speed | 1.7 m/min. |
| Pressure | 200 Kg |
| ON:OFF | 1:1 ∞ |
| Width of Electrode | 3 mm |

Experiments were effected under the conditions as specified in Table 3. The electro-chromated product provided an insufficient nugget since the current value dropped from the predetermined current value due to poor electric conductivity of the film formed on the surface thereof, whereas the inventive product provided a good nugget comparable to that of the green product without suffering any current drop. This means that the welded portion is good.

TABLE 4

| TIG Lap Joint Welding Condition | |
|---|---|
| Test Piece | Upper Plate: 1.5 mm$^t$ Lower Plate: 0.7 mm$^t$ |
| Welding Current | 88 A |
| Welding Speed | 35 cm/min. |
| Electrode | TH-containing W 1.6 $\phi$ |
| Arc Length | 1 mm |
| Shielding Gas | Ar 12 l/min. |

Weldability was estimated under the TIG lap joint welding conditions as specified in Table 4. The results are shown in Table 5.

TABLE 5

| Test Piece | Fluidity of Molten Metal in TIG Lap Welding and Weldability: Fluidity | Weldability |
|---|---|---|
| Green Product | | |
| Ni plating plus chromating Inventive Product | | |
| Electro-chromating Control Product | ▽ | ▽ |

: good

Δ: somewhat inferior

The electro-chromated product is somewhat inferior of molten metal to the green product, and the compatability of molten metal with the lower plate is too unsatisfactory to obtain good weldability. However, the inventive product is satisfactory in the fluidity of molten metal, so that the compatibility of the molten metal with the lower plate is satisfactory. Thus, the inventive product is comparable in weldability to the green product.

The tension and charpy impact test for TIG welded joints were carried out. The results are set forth in Tables 6 and 7.

TABLE 6

| Test Pieces | Tension Test for TIG Butt Welded Joint (1.5 mm$^t$) (room temperature): 0.2% force (Kg/mm$^2$) | Tensile Strength (Kg/mm$^2$) | Elongation (%) | Rupture Position |
|---|---|---|---|---|
| Green Product | 29.4 | 40.0 | 12.2 | bead |
| Ni plating plus chromating (Inventive Product | 30.5 | 41.7 | 13.3 | bead |
| Electro-chromating | 29.9 | 39.8 | 11.7 | bead |

TABLE 6-continued

| Test Pieces | Tension Test for TIG Butt Welded Joint (1.5 mm$^t$) (room temperature) 0.2% force (Kg/mm$^2$) | Tensile Strength (Kg/mm$^2$) | Elongation (%) | Rupture Position |
|---|---|---|---|---|
| (Control Product) Longitudinally taken Base Metal (to be welded) | 31.5 | 49.0 | 42.0 | — |

TABLE 7

| Test piece | Charpy Impact Test for TIG Butt Welded Joint (1.5 mm$^t$, 0.25$^R$45°2 mm V notch) Test temperature 20° C. | −196° C. |
|---|---|---|
| Green Product | 9.1 Kg · m/cm$^2$ | 9.1 Kg · m/cm$^2$ |
| Ni plating plus chomating (Inventive Product) | 8.6 Kg · m/cm$^2$ | 8.7 Kg · m/cm$^2$ |
| Electro-chromating Control Product | 9.2 Kg · m/cm$^2$ | 9.4 Kg · m/cm$^2$ |
| Longitudinally taken Base Metal (to be welded) | 9.3 Kg · m/cm$^2$ | 6.7 Kg · m/cm$^2$ |

The inventive product has a tensile strength somewhat lower than that of the base metal (green product), but shows a tensile strength and an elongation under force, both bearing comparison to those of the green product. The reason why the inventive, green and electro-chromated products have an elongation lower than that of the base metal is that the bead portion of the welded joint should be raptured. The inventive product has a good Charpy impact value comparable to that of the green product or the base metal at +20° C. and −196° C. This means that the inventive product also excels in impact resistance.

As mentioned above, the product according to the present invention can be fusion- or resistance-welded without causing any change in the welding conditions applied to the green product, and shows a weldability equivalent to that of the green product.

What is claimed is:

1. A method of increasing the corrosion resistance of a nickel/iron alloy steel plate for LNG or LPG tanks said plates having a 35–37% nickel content as provided by ASTM SA-658 comprising the steps of:

(1) coating said steel with metallic nickel in an amount of about 1 to 10 g/m$^2$ calculated as nickel metal; and (2) surface treating said nickel/iron alloy steel plate coated with metallic nickel with a chromating step so as to provide a chromate film on said metallic nickel coating, said chromate film containing 5 to 100 mg/m$^2$ of chromate calculated as chromium metal.

2. The method of claim 1 wherein the nickel coating step of (1) is selected from the group consisting of electroplating and electroless plating.

3. The method of claim 2 wherein the nickel coating step is an electroplating step.

4. The method of claim 1 wherein the chromating step of (2) comprises treating with chromating solution containing hexavalent chromium, in an amount of about 10 to 200 g/l and trivalent chromium in an amount of 20 to 60% by weight relative to the total chromium content.

* * * * *